US006108862A

United States Patent [19]

Frederick et al.

[11] Patent Number: 6,108,862

[45] Date of Patent: Aug. 29, 2000

[54] HAND GRIP AND UPPER HANDLE ASSEMBLY FOR A SELF-PROPELLED UPRIGHT VACUUM CLEANER

[75] Inventors: Lynn A. Frederick, Brady Lake; Jeffery A. Morgan, Cuyahoga Falls; Daniel R. Miller, Canton; John A. Leonatti, Uniontown; Nick M. Bosyj, North Canton, all of Ohio

[73] Assignee: The Hoover Company, North Canton, Ohio

[21] Appl. No.: 09/074,845

[22] Filed: May 8, 1998

[51] Int. Cl.[7] ..... A47L 9/28

[52] U.S. Cl. ..... 15/340.2; 15/410; 180/19.3

[58] Field of Search ..... 15/340.2, 410; 180/19.3

[56] References Cited

U.S. PATENT DOCUMENTS

| | | | |
|---|---|---|---|
| 2,218,160 | 10/1940 | Becker . | |
| 2,243,067 | 5/1941 | Berg . | |
| 2,986,765 | 6/1961 | Ernolf et at. | 15/410 X |
| 3,581,591 | 6/1971 | Ziegler . | |
| 3,618,687 | 11/1971 | Ripple et al. . | |
| 3,631,559 | 1/1972 | Gaudry et al. . | |
| 3,766,594 | 10/1973 | Westergren et al. | 15/410 X |
| 3,857,076 | 12/1974 | Hetland . | |
| 3,938,216 | 2/1976 | Schmitz et al. | 15/340.2 |
| 4,155,143 | 5/1979 | Garbe . | |
| 4,342,369 | 8/1982 | Ransom . | |
| 4,516,289 | 5/1985 | Sumerau | 15/410 |
| 4,624,027 | 11/1986 | Martin . | |
| 4,845,803 | 7/1989 | King . | |
| 4,893,376 | 1/1990 | Sunagawa et al. . | |
| 4,905,341 | 3/1990 | Sunagawa et al. . | |
| 4,947,512 | 8/1990 | Lackner et al. | 15/410 X |
| 5,003,663 | 4/1991 | Sunagawa et al. . | |
| 5,226,527 | 7/1993 | Maurer et al. . | |
| 5,339,916 | 8/1994 | Louis . | |
| 5,406,674 | 4/1995 | Lawter et al. . | |
| 5,608,946 | 3/1997 | Rennecker et al. | 15/340.2 X |

FOREIGN PATENT DOCUMENTS

| | | |
|---|---|---|
| 2321393 | 7/1998 | United Kingdom . |

*Primary Examiner*—Chris K. Moore
*Attorney, Agent, or Firm*—A. Burgess Lowe; Bruce P. Watson

[57] ABSTRACT

A self propelled upright vacuum cleaner is provided that has at least one drive wheel, a transmission for selectively driving the drive wheel in forward and reverse and propelling the cleaner in forward and reverse over a floor. A bag housing pivotally connected to the floor engaging portion. An electric power switch located adjacent to a top of the bag housing. A control link extending from the transmission and up the bag housing, with a top end of the control link being located adjacent to the top of the bag housing. An upper handle assembly having a hand grip reciprocally mounted thereon and a power switch button mounted thereon. The lower end of the upper handle assembly is adapted for connection to the top of the bag housing, such that the upper end of the control link and the hand grip are automatically interconnected when the upper handle assembly is attached to the bag housing. Furthermore, the power switch the power button are operatively interconnected when the upper handle assembly is attached to the bag housing.

25 Claims, 7 Drawing Sheets

HAND GRIP AND UPPER HANDLE ASSEMBLY FOR A SELF-PROPELLED UPRIGHT VACUUM CLEANER

BACKGROUND OF THE INVENTION

1. Field of the Invention

This invention pertains to a self-propelled upright vacuum cleaner. More specifically, this invention pertains to a hand grip and upper handle assembly for a self-propelled upright vacuum cleaner and the manner of attaching such a hand grip and upper handle assembly to a self-propelled upright vacuum cleaner.

2. Background of the Invention

It is known to produce a self-propelled upright vacuum cleaner by providing a transmission in the foot or lower porion of the cleaner for selectively driving at least one drive wheel in forward rotation and reverse rotation for selectively propelling the cleaner forward and backward over a floor. A handgrip is commonly mounted to top of the bag housing in a sliding fashion for limited reciprocal motion relative to the bag housing as an operator pushes and pulls on the handgrip. A Bowden type control cable typically extends from the hand grip to the transmission for transferring the pushing and pulling forces applied to the hand grip by an operator to the transmission and thereby selectively actuating a forward drive clutch and a reverse drive clutch of the transmission.

Due to the limited space available in an upright vacuum cleaner for the transmission, the transmission must be very compact in design. The mechanism for engaging the forward and reverse drive clutches of the transmission must likewise be very compact and must operate in a confined space. As a result, the transmission must be activated by relatively small movements of the control cable relative to the transmission. In order to ensure that the forward and reverse gears of the transmission are reliably engaged, the length of the control cable between the hand grip and the transmission must be accurately adjusted. As such, the connection between the control cable and the hand grip must be made within tight tolerances, or else the length of the control cable between the hand grip and the transmission will be a little too long or a little too short. If the control cable is too long or too short, then the forward or reverse drive clutch of the transmission my fail to be engaged when an operator pushes and pulls on the hand grip.

Prior art self-propelled vacuum cleaners have typically been fully assembled at the factory in order to ensure that the control cable is accurately attached to the hand grip within the required tolerances. A fully assembled upright vacuum cleaner, however, must be shipped in a relatively large box. A large box makes it expensive to package and ship such a vacuum cleaner. As a result, it is desirable to ship upright vacuum cleaners with the upper handle unattached to the bag housing in order to reduce the overall height of the cleaner and thereby greatly reduce the size of the box required for shipping the cleaner. When a vacuum cleaner is shipped with the upper handle unattached, then the consumer must attach the upper handle to the cleaner. In self propelled upright vacuum cleaners, the consumer must then also form the connection between the hand grip and the control cable. As discussed above, if the connection between the hand grip and the control cable is not made within tight tolerances, then the transmission will fail to properly drive the cleaner in both forward and reverse.

A self propelled upright vacuum cleaner in which the upper handle assembly may be packaged unattached and subsequently attached to the bag housing by the consumer is disclosed in U.S. Pat. No. 4,155,143. In the disclosed cleaner, the upper handle assembly is telescopically attached to the bag housing by vertically lowering the upper handle into an opening in the top of the bag housing. The upper handle assembly of the disclosed cleaner includes a control rod that extends down from the hand grip. A snap connector is located on the lower end of the control rod. A mating snap connector is located on the upper end of the control cable in the bag housing. The two snap connectors are located such that as the upper handle assembly is telescopically lowered into the opening in the bag housing, the two connectors are snapped together. Thus, the hand grip is automatically connected to the control cable when the upper handle assembly is attached to the bag housing by the consumer. However, the snap connectors in the disclosed arrangement are prone to being pushed vertically out of place when the handle is attached to the cleaner, such that the transmission fails to be actuated properly.

SUMMARY OF THE INVENTION

It is an object of the present invention to provide a self-propelled upright vacuum cleaner having an upper handle assembly that can be reliably attached to the bag housing by a consumer.

It is a further object of the present invention to provide a self-propelled upright vacuum cleaner with an upper handle assembly having a reciprocating hand grip, which upper handle assembly can be reliably attached to the bag housing by a consumer in a manner that automatically forms a reliable and accurate connection between the hand grip and a control cable or other mechanism for transferring forces from the hand grip to the transmission.

It is a further object of the present invention to provide such a self propelled vacuum cleaner in which the upper handle assembly is attached to the bag housing by moving the upper handle assembly in a direction normal to the longitudinal axis of the bag housing, so that connection of the upper handle assembly can be made without destroying the factory set adjustment of the transmission control cable.

It is a further object of the present invention to provide a self-propelled upright vacuum cleaner with an upper handle assembly having a power switch button, which upper handle assembly can be reliably attached to the bag housing by a consumer in a manner that automatically forms a reliable connection between the power switch button and an electrical power switch located in the bag housing.

BRIEF DESCRIPTION OF THE DRAWINGS

A preferred embodiment of the present invention will now be described, by way of example, with reference to the accompanying drawings, of which:

FIG. 10 illustrates the switch rod in the "off" position and FIG. 11 illustrates the switch rod in the "on" position.

DETAILED DESCRIPTION OF THE INVENTION

Figure 1:
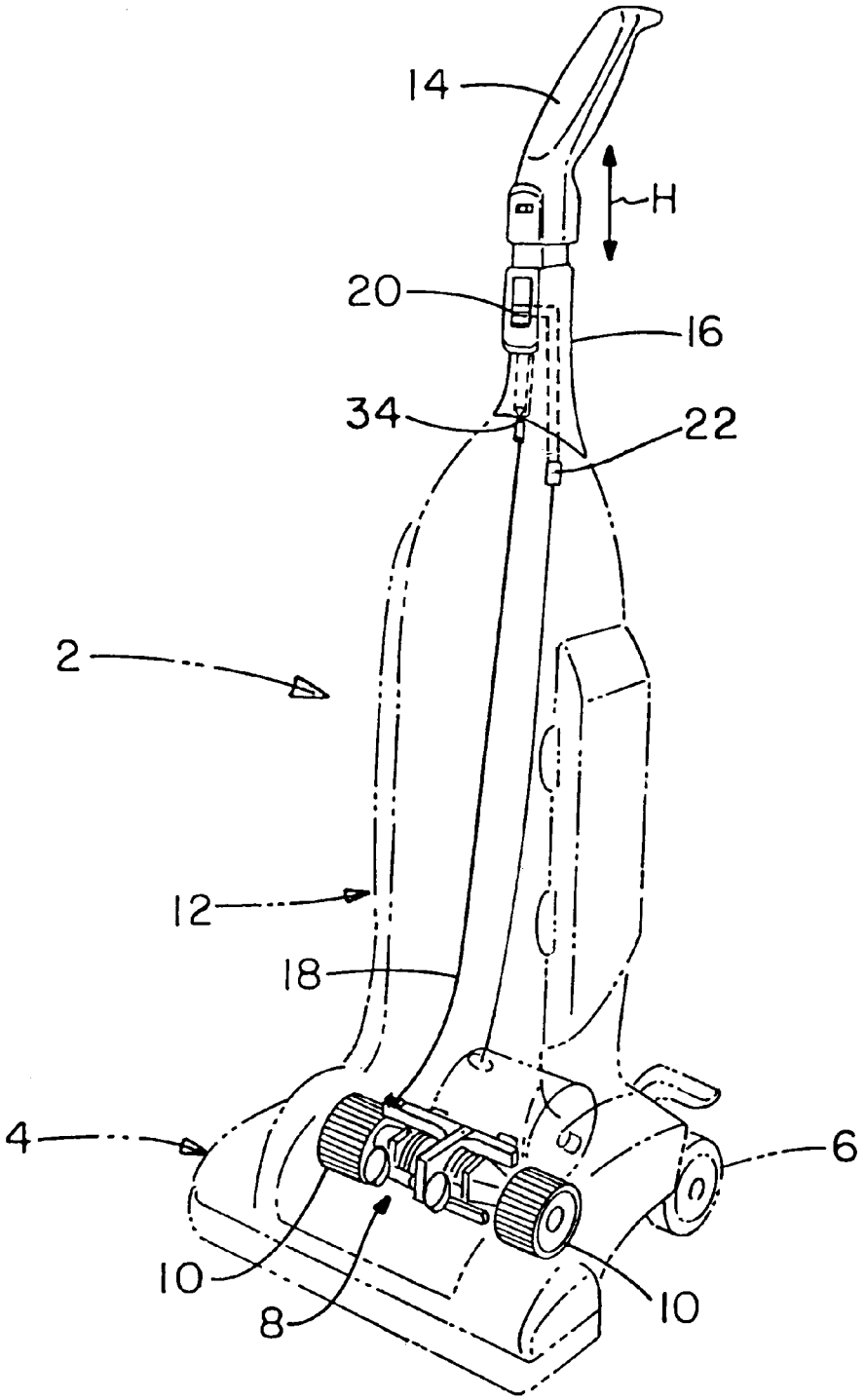
FIG. 1 is a diagrammatic perspective view of a self-propelled upright vacuum cleaner according to the present invention.

A self-propelled upright vacuum cleaner 2 according to a preferred embodiment of the present invention is diagrammatically illustrated by way of example in FIG. 1. The cleaner includes a foot or lower engaging portion 4. The foot includes a floor nozzle, not visible in FIG. 1, located to the front of the foot. Freely rotating support wheels 6 (only one of which is visible in FIG. 1) are located to the rear of the foot. The foot further includes a transmission 8 and drive wheels 10 for propelling the cleaner in forward and reverse over a floor. The details of the transmission do not form a part of the present invention and are therefore not disclosed in detail herein. However, a suitable transmission for use with a self-propelled upright vacuum cleaner according to the present invention is disclosed in U.S. Pat. No. 3,581,591, the disclosure of which is hereby incorporated herein as of reference.

A bag housing or handle portion 12 is pivotally mounted to the foot 4 in a conventional manner for pivotal motion from a generally upright latched storage position, illustrated in FIG. 1, to an inclined pivotal operating position, not shown in FIG. 1. A hand grip 14 is slidably mounted to a handle stem 16 that is attached to the upper end of the bag housing 12 for limited reciprocal rectilinear motion relative to the handle stem as illustrated by arrow H. The hand grip is connected to the transmission via a Bowden type control cable 18. As an operator pushes and pulls on the hand grip 14, the cable actuates the transmission to automatically drive the cleaner in forward and reverse in response to the forces applied to the hand grip by the operator. A power switch button 20 is preferably located adjacent to a top of the handle stem near the hand grip for convenient actuation of an electric power switch 22 for turning the cleaner on and off.

Figure 2:
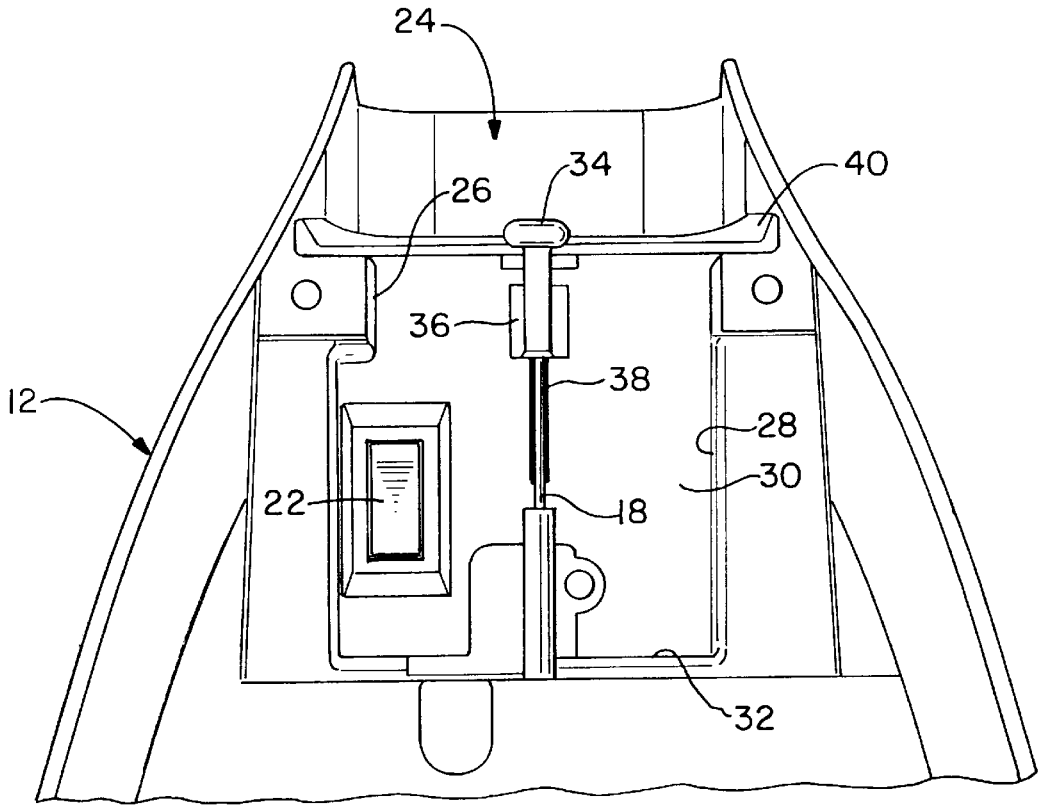
FIG. 2 is a rear view of a vacuum cleaner bag housing with a cavity for receiving an upper handle assembly according to the present invention.
Figure 3:
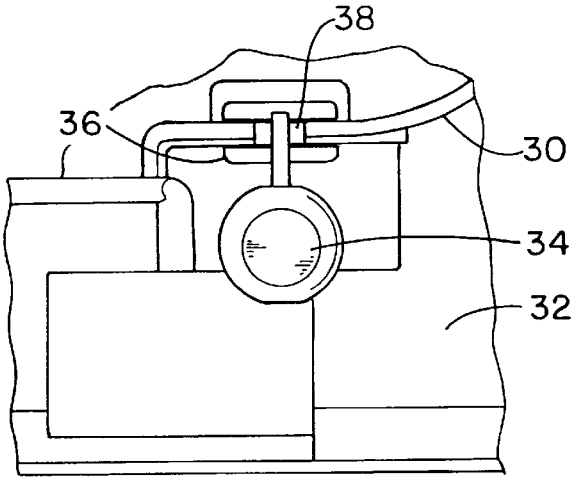
FIG. 3 is a partial top view of the bag housing.

FIGS. 2 and 3 are a partial rear and top view, respectively, of the vacuum cleaner according to the present invention, prior to attachment of an upper handle assembly to be described in detail below. A cavity 24 is formed in the top rear of the bag housing 12. The cavity is defined by substantially vertical sidewalls 26 and 28, a substantially vertical inner wall 30 and a substantially horizontal lower wall 32, such that the cavity is open at the top and at the rear of the bag housing. The control cable 18 extends through a hole (not shown) in the lower wall and a mushroom shaped cable end piece 34 is attached to the end of the cable. The cable end piece includes an H-shaped portion 36, see FIG. 3, that is dovetailed in a slot 38 passing through the inner wall 30 of the cavity 24, such that the cable end piece is slidably mounted for reciprocal vertical rectilinear motion in the cavity. The electric power switch 22 is also mounted in the cavity on the inner wall 30, as illustrated in FIG. 2. The power switch is a rearward facing toggle switch. A substantially horizontally extending peripheral groove 40 is formed in the sidewalls and the inner wall of the cavity.

Referring now to FIGS. 4 through 7, the upper handle assembly 42 includes the hand grip 14 that is mounted to the top of the handle stem 16 for limited rectilinear reciprocal motion relative to the handle stem. The hand grip includes a grip rod 44 having a lower stem portion 46 and an upper grip portion 48 that is located at an angle relative to the stem portion 46. A front grip half 50 and a rear grip half 52 are sandwiched about the grip portion 48 of the grip rod such that two snap connections 54 and 56, located one to either side of each of the grip halves, are snapped together. Two screws 58 are then passed through the rear grip half, through the grip portion of the grip rod, and are threaded into the front grip half to secure the grip halves in place upon the grip portion of the grip rod.

Figure 4:
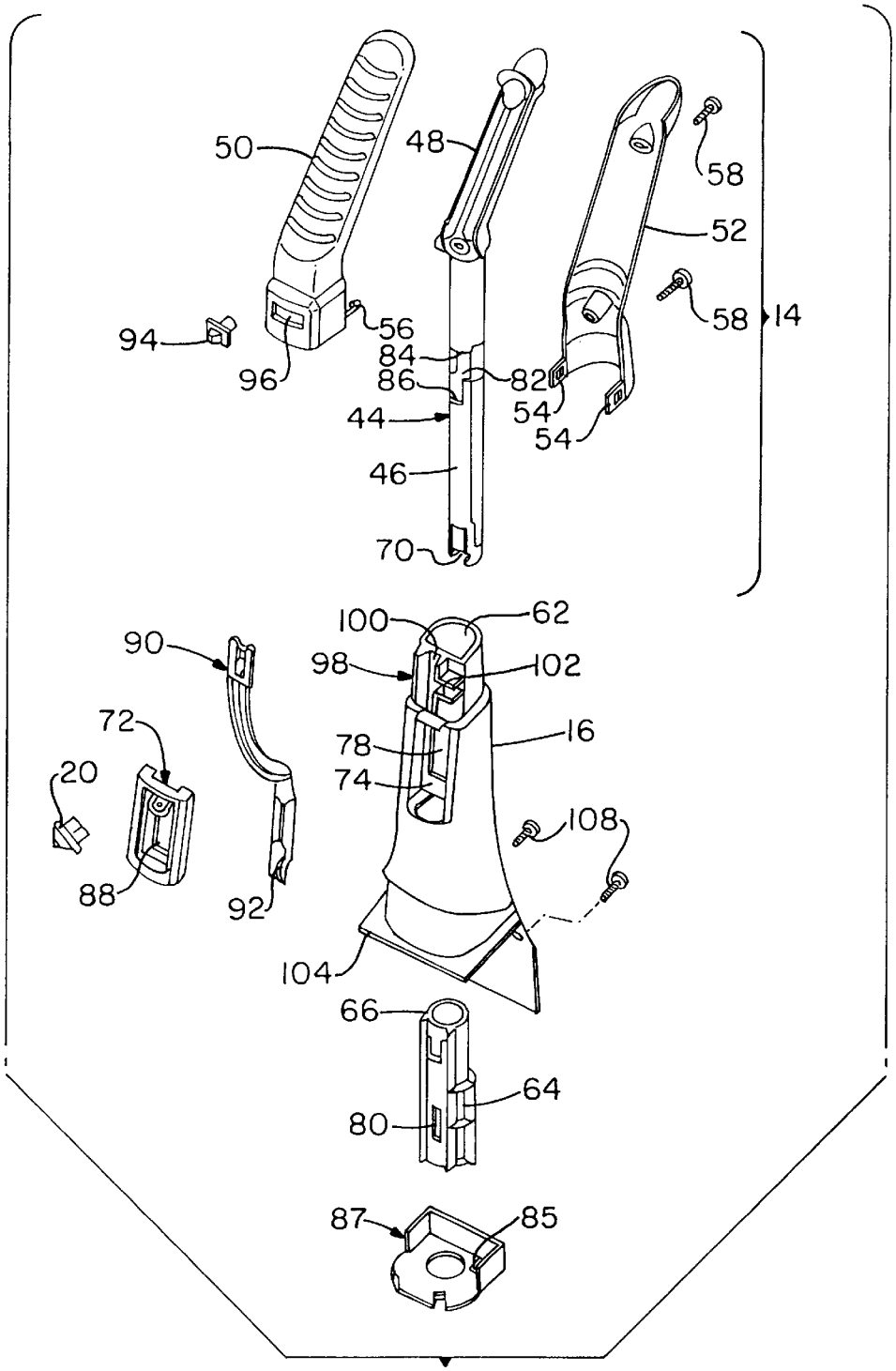
FIG. 4 is an exploded view of a hand grip and upper handle assembly according to the present invention.
Figure 5:
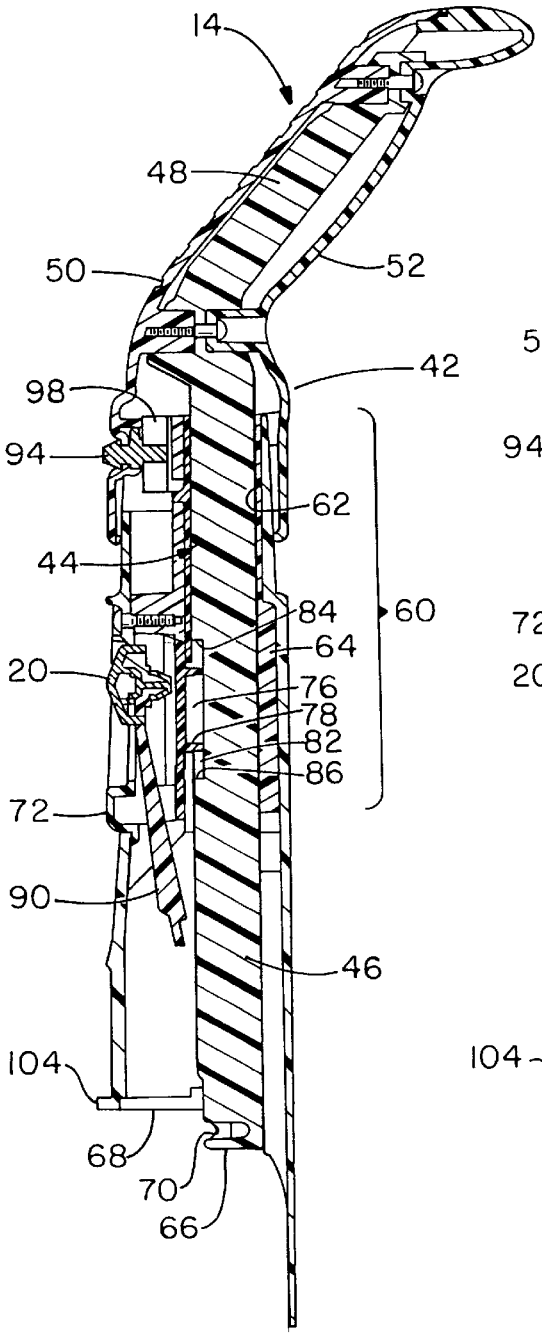
FIG. 5 is a longitudinal, front to back cross-section of the handle assembly.
Figure 7:
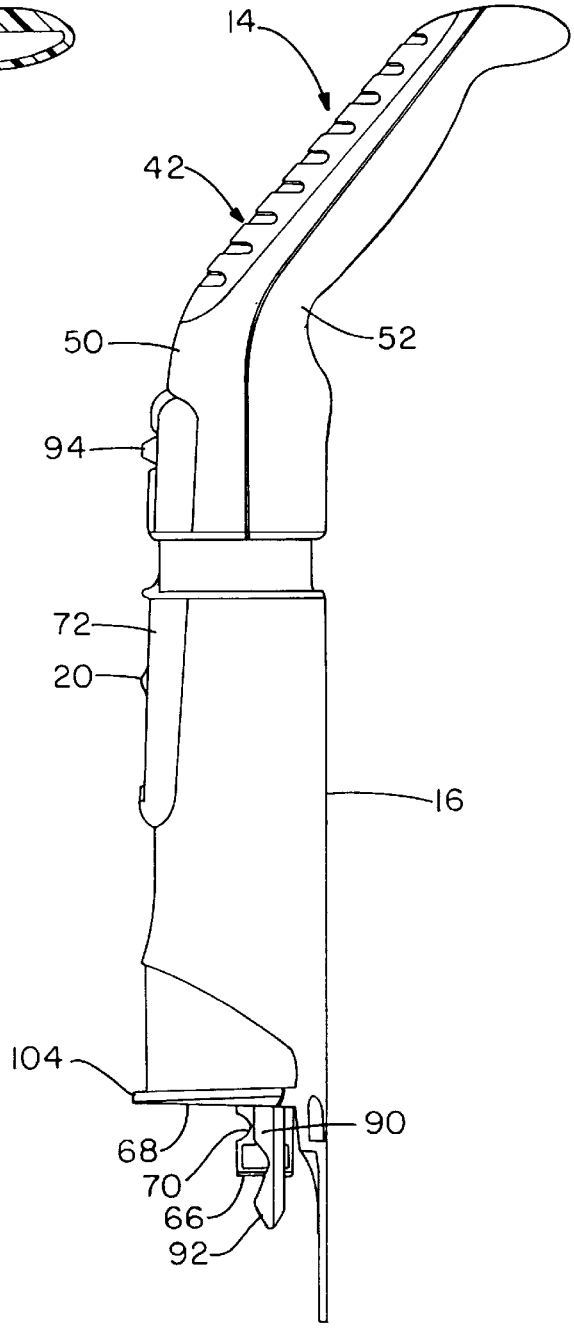
FIG. 7 is a side view of the upper handle assembly.

With particular reference to FIGS. 4 and 5, the handle stem 16 is an upwardly tapering hollow tubular member. A top portion 60 (see FIG. 5) of the handle stem has an inner peripheral surface 62 having a centrally located D-shaped cross section, as best seen in FIG. 4. A hollow tubular handle sleeve 64, preferably made of Delrin™, is centrally located in the top portion 60 of the handle stem. The handle sleeve has an outer peripheral surface that approximates a generally D-shaped cross-section. The handle sleeve 64 is non-rotatably received within the D-shaped opening in the upper portion of the handle stem. The handle sleeve also has a D-shaped inner peripheral surface 66 in cross-section. The stem portion 46 of the grip rod has a D-shaped cross section that is sized to be slidably received within the handle sleeve 64 as shown in FIG. 5. The hand grip 14 is mounted to the top of handle stem 16 by telescopically sliding the stem portion of the grip rod into the top of the handle sleeve until a lower end 66 of the grip rod extends below a lower end 68 of the handle stem. A forwardly opening T-shaped notch 70 is located in the lower end of the grip rod 44, below the lower end 68 of the handle stem, for receiving the cable end piece 34, as discussed in further detail below. The D-shaped cross-section of the stem portion 46 of the grip rod, the handle sleeve 64 and the inner surface 62 of the top portion of the handle stem prevent the hand grip 14 from twisting or rotating about the longitudinal axis of the stem portion of the grip rod relative to the handle stem.

The upper handle assembly 42 further includes a switch pocket 72 mounted in a recess 74 in the front of the handle stem. A vertically extending ridge 76 (shown in FIG. 5) extends from a rear or inner surface of the switch pocket, through a slot 78 in the recess in the handle stem, through a slot 80 in the handle sleeve, and is received in a longitudinally extending recess 82 in the stem portion 46 of the grip rod 44, as illustrated in FIG. 5. With this construction, the ridge on the rear of the switch pocket engages upper 84 and lower 86 extremities of the recess in the grip rod and thereby limits the upward and downward vertical travel of the grip rod 44, and therefore of the handgrip 14, relative to the handle stem 16.

Figure 6:
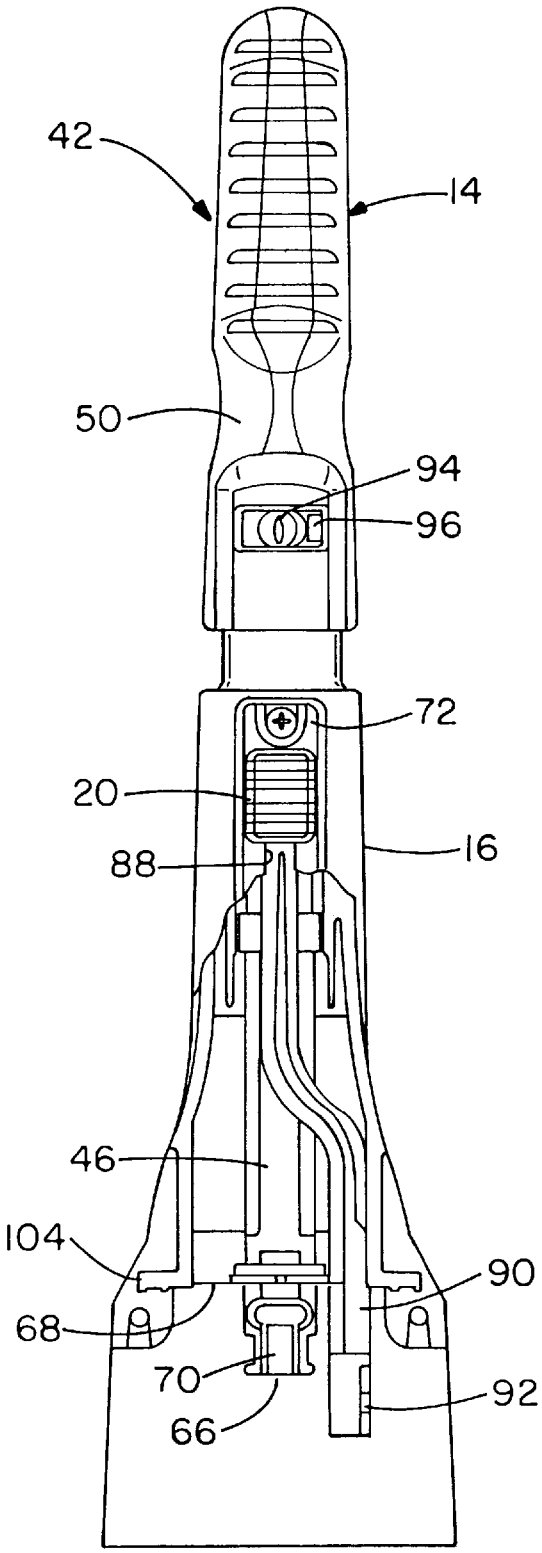
FIG. 6 is a partially broken away front view of the upper handle assembly.

The power switch button 20 is vertically reciprocally mounted in a vertically extending slot 88 formed in the switch pocket 72. The switch button is attached to a switch rod 90 located within the handle stem. As illustrated in FIGS. 5 and 6, the switch rod extends down from the switch button 20, through an opening in the switch pocket, and out the lower end 68 of the handle stem. A lower end of the switch rod includes a forward facing cam bump 92 for actuating the electric power switch 22 (not shown in FIGS. 4–7) as explained in further detail below. The switch rod extends through an opening 85 in a guide plate 82 mounted in the open lower end 68 of the handle stem.

As discussed above, the ridge 76 on the rear of the switch pocket 72 limits the upward travel and downward travel of the hand grip 14 relative to the handle stem 16. When an operator pulls on the hand grip, the hand grip moves up relative the handle stem, as viewed in FIGS. 5 through 7, into a reverse position in which the ridge 76 on the switch pocket contacts the lower extremity 86 of the recess 82 in the grip rod. Alternatively, when an operator pushes on the hand grip, the hand grip moves down relative the handle stem, as viewed in FIGS. 5 through 7, into a forward position in which the ridge 76 on the switch pocket contacts the upper extremity 84 of the recess in the grip rod. A lockout pin 94 is mounted in a horizontally extending slot 96 passing through the front grip half 50. The lockout pin extends through the front grip half and is received in a "sideways T-shaped" recess 98 in the front surface of the handle stem 46. The "top" 100 of the T-shaped recess extends vertically and the "leg" 102 of the T-shaped recess extends horizontally. When the operator locates the lockout pin to the left, as viewed in FIG. 6, in a "propelled" position, the lockout pin extends into the vertically extending "top" of the T-shaped recess for allowing the hand grip to move up and down relative the handle stem to actuate the transmission. Alternatively, when an operator moves the lockout pin to the right, as viewed in FIG. 6, into an "unpropelled" position, the lockout pin extends into the horizontally extending "leg" of the T-shaped recess and thereby vertically locks the handgrip in place relative to the handle stem in a neutral position.

Figure 8:
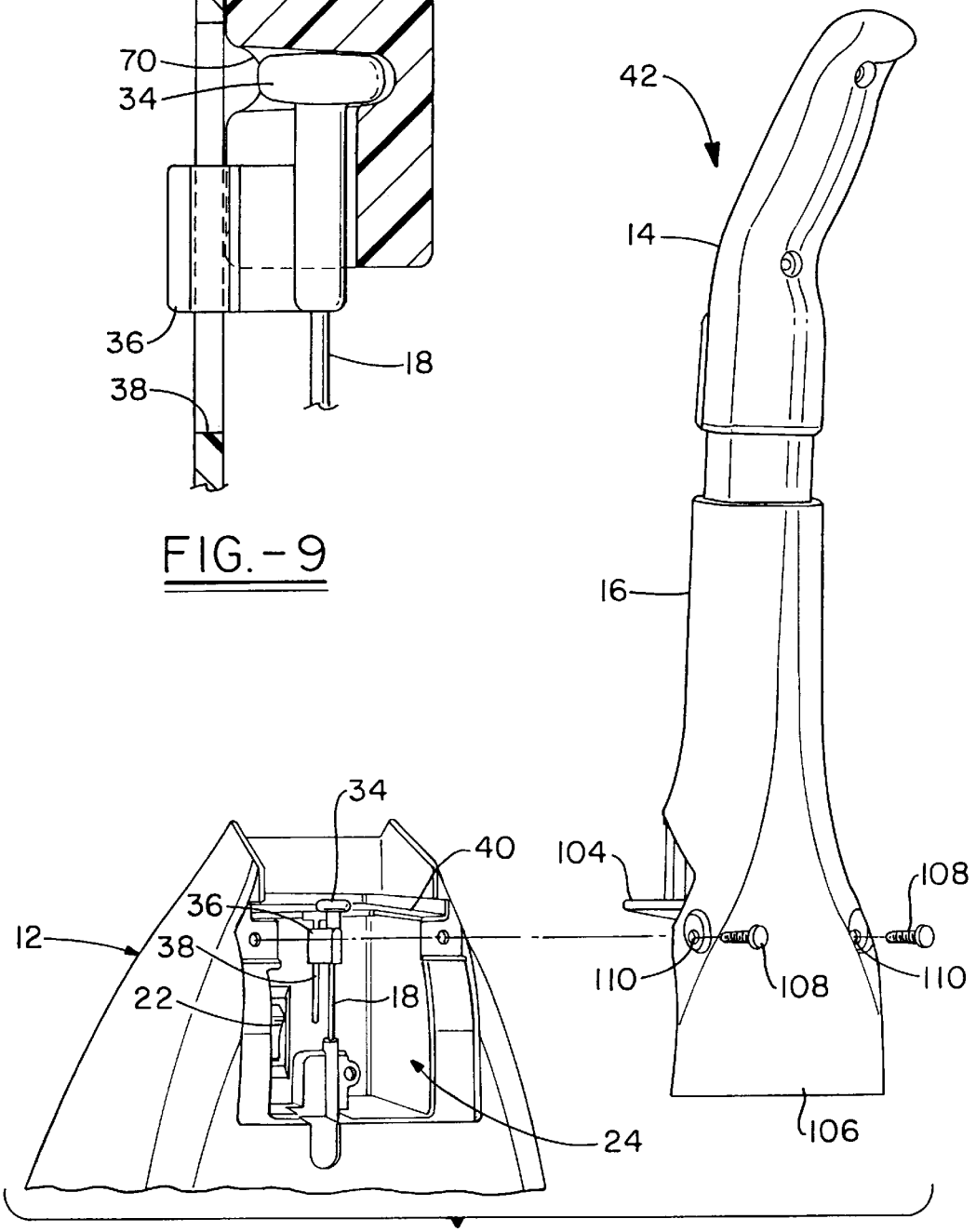
FIG. 8 is a partially exploded rear view showing the top of the bag housing and the upper handle assembly just prior to assembly of the upper handle assembly with the bag housing.

A peripheral flange 104 extends out from either side and from the front of the lower end 68 of the handle stem 16. In order to attach the upper handle assembly 42 to the bag housing 12, the peripheral flange 104 on the handle stem is aligned with the horizontal groove 40 in the cavity 24 in the bag housing as illustrated in FIG. 8. The upper handle assembly is then moved forward, sliding the peripheral flange on the handle stem into the groove in the cavity in the bag housing until a rear wall 106 extending down from the lower end of the handle stem encloses the cavity in the bag housing. Two screws 108 are then passed through holes 110 passing through the downwardly extending wall and are threaded into the bag housing to securely attach the upper handle assembly 42 to the bag housing 12.

Figure 9:
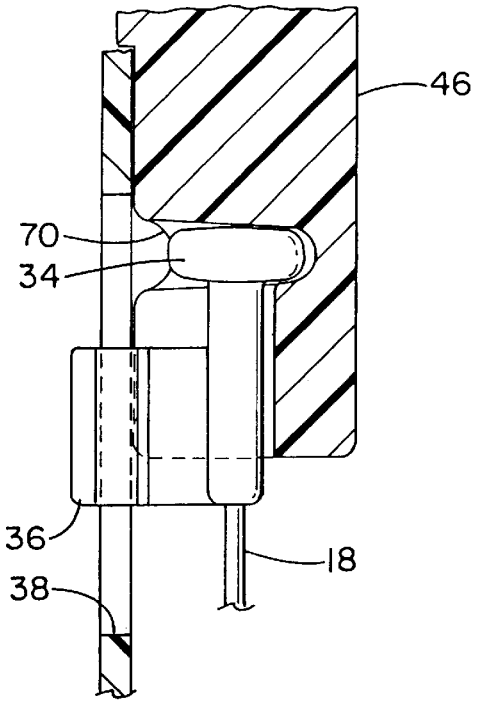
FIG. 9 is a diagrammatic cross-section illustrating the connection between the grip rod in the upper handle assembly and the control cable.

As discussed above, and as illustrated in FIGS. 5 through 7, the grip rod 44 and the switch rod 90 both extend out the lower end 68 of the upper handle assembly 42. The stem portion 46 of the grip rod is positioned within the cavity 24 by the handle sleeve 64, such that when the upper handle assembly is slid forward in to the cavity, the cable end piece 34 is received in the T-shaped groove 70 in the lower end 66 of the grip rod, as illustrated in FIG. 9. The cable end piece is thus positively captured in the T-shaped groove, so that when the hand grip 14 is moved up and down relative the handle stem, the control cable 18 is likewise moved up and down for actuating the transmission and propelling the vacuum cleaner in forward and reverse.

Figure 10:
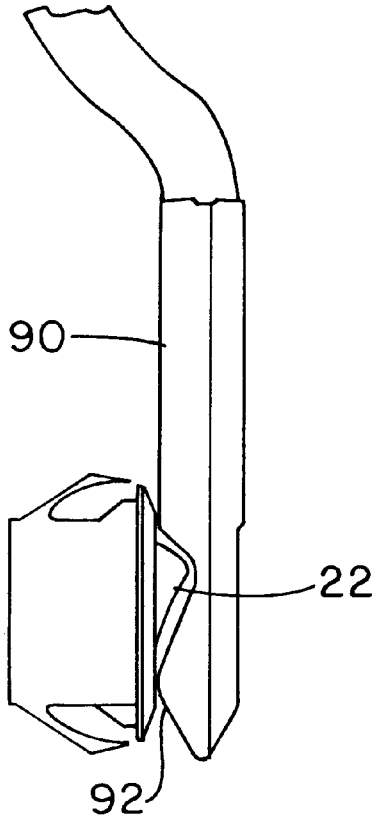
FIGS. 10 and 11 are diagrammatic cross-sections illustrating the connection between the switch rod in the upper handle assembly and the power switch.
Figure 11:
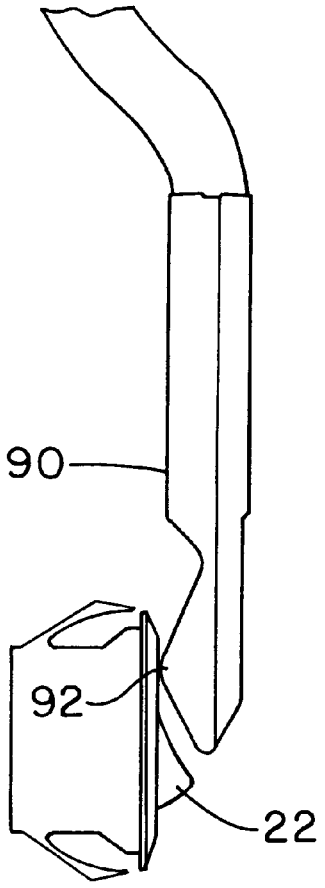

The hole 85 in a guide plate 87 locates the lower end of the switch rod 90, such that when the upper handle assembly 42 is slid forward into the cavity 24 the cam bump 92 on the switch rod is located in abutting engagement with the power switch 22 as illustrated in FIGS. 10 and 11. As a result, when the switch button 20 (not shown in FIGS. 10 and 11) is pushed down into its "off" position by an operator, the cam bump places the power switch in the "off" position as illustrated in FIG. 10. When an operator moves the switch button up to its "on" position, the cam bump places the power switch in the "on" position for powering the cleaner as illustrated in FIG. 11. With this construction, the power switch button 20 may be conveniently located up on the upper handle assembly 42 where it can be easily actuated by an operator without having to stoop.

The transmission 8 naturally remains in the unbiased neutral position until it is actuated by a force applied by the control cable 18. Therefore, the hand grip 14 is preferably locked in its neutral position prior to attachment of the upper handle assembly 42 to the bag housing 12. Locking the hand grip in the neutral position ensures that the T-shaped recess in the lower end of the grip rod is properly located to receive the cable end piece 34 therein when the handle assembly is attached to the bag housing. The hand grip is preferably locked in its neutral by first locking the hand grip in the neutral position with the lockout pin 94, and then inserting a removable tab (not shown) into the slot 96 in the front grip half to the left of the lockout pin as viewed in FIG. 6. The removable tab prevents the hand grip from accidentally moving into the "propelled" position until the tab is removed from the slot. The lockout pin may alternatively be taped or otherwise temporarily fixed in the unpropelled position.

The power switch button 20 (which is illustrated in the "on" position in FIG. 6) is preferably retained in the off position by inserting a removable tab (not shown) in the slot 88 above the switch button prior to attachment of the upper handle assembly to the bag housing. Securing the switch button in its off position ensures that the power switch will remain in the off position, as preset at the factory, until after the upper handle assembly is attached to the bag housing. Accidental activation of the electric power switch 22 upon attachment of the upper handle assembly to the bag housing is thus prevented. It will be appreciated that the switch button may alternatively be retained in its off position with tape or any other suitable means.

The upper handle assembly is very accurately located within the cavity in the bag housing by the close fit between the peripheral flange 104 on the handle stem 16 and the peripheral groove 40 in the cavity 24. Thus, the T-shaped recess 70 in the grip rod is very accurately guided over the cable end piece 34 as the upper handle assembly is slid horizontally into the bag housing. As a result, the T-shaped recess in the grip rod may be formed just slightly larger than the cable end piece. With this construction, a highly accurate connection is formed between the hand grip and the control cable simply by sliding the upper handle assembly horizontally into the cavity in the bag housing prior to removing the removable tab holding the lockout pin in place. Since the cable end piece and the control cable are mutually engaged by horizontally sliding the upper handle assembly into the bag housing, there is no danger of vertically displacing the cable end piece when making this connection. As a result, the control cable 18 does not have to be connected to the hand grip 14 at the factory in order to ensure that the control cable is accurately adjusted to place the transmission in forward and reverse as an operator pushes and pulls on the hand grip.

The control cable is preferably calibrated at the factory by temporarily attaching the upper handle assembly to the bag housing, neutralling the transmission actuator arm with the hand grip locked in neutral by the lockout pin, and then tightening a screw that clamps the lower end of the control cable to the actuator arm.

It will be appreciated that any suitable control link may be substituted for the disclosed the Bowden control cable without departing from the scope of the present invention. For example, a flexible strap, a rigid link or a system of rigid links may be substituted for the control cable.

The present invention thus enables an accurate connection between the control cable and the hand grip to be reliably made by a consumer simply by attaching the upper handle assembly to the bag housing prior to removing the removable tabs. As a result, the self-propelled vacuum cleaner according to the present invention may be shipped with the upper handle assembly 42 unattached. Shipping the cleaner with the upper handle assembly unattached enables the cleaner to be shipped in a much smaller carton than when the cleaner is shipped with the upper handle assembly attached to the cleaner, thereby creating savings in packaging and shipping costs.

The present invention has been described above using a preferred embodiment by way of example only. Obvious modifications will become apparent to one of ordinary skill upon reading the above description and viewing the appended drawings. The present invention described above and as claimed in the appended claims is intended to include all such obvious modifications within the scope of the present invention.

Wherefore we claim:

1. A self-propelled vacuum cleaner having an electric motor, a floor engaging portion having a suction inlet and at least one drive wheel for propelling said vacuum cleaner over a floor surface, a transmission for selectively drivingly connecting said motor to said at least one drive wheel and selectively propelling said cleaner in forward and reverse directions over a floor surface, a housing pivotally connected to said floor engaging portion, wherein the improvement comprises:

an electric power switch located adjacent to a top of said housing and electrically connected to said motor for selectively turning said motor on and off;

a control link in said housing having a lower end attached to said transmission for selectively actuating said transmission into forward, reverse and neutral and an upper end located adjacent to said housing remote from said transmission; and a handle stem having a hand grip reciprocally mounted thereon and a power button mounted thereon, a grip rod extending down from said hand grip and out a lower end of said handle stem, and a switch rod extending down from said power button and out the lower end of said handle stem;

wherein the lower end of said handle stem is adapted for connection to the top of said housing, said upper end of said control link and a lower end of said grip rod are configured and located such that said lower end of said grip rod engages and interconnects with said upper end of said control link when said handle stem is attached to said housing, and said power switch and a lower end of said switch rod are located and configured such that said lower end of said switch rod engages said power switch when said handle stem is attached to said housing, whereby an operator may actuate the transmission via said hand grip and actuate said power switch via said power button.

2. A self-propelled vacuum cleaner according to claim 1, wherein said handle stem is a hollow tubular member and said grip rod is telescopically reciprocally received in said handle stem.

3. A self-propelled vacuum cleaner according to claim 2, further comprising a longitudinally extending recess in said grip rod, said recess having an upper end wall and a lower end wall longitudinally delimiting said recess; and a protrusion extending inward from an inner peripheral surface of said handle stem, said protrusion being located in said recess in said grip rod, whereby said protrusion engages said upper and lower end walls of said recess and thereby limits reciprocal motion of said hand grip relative to said handle stem.

4. A self-propelled vacuum cleaner according to claim 3, wherein said protrusion is located on an insert that is mounted in an opening in said handle stem located opposite said recess in said grip rod.

5. A self-propelled vacuum cleaner according to claim 4, wherein said insert is a switch pocket having a vertically extending slot passing therethrough, and said power button is reciprocally received in said slot in said switch pocket.

6. A self-propelled vacuum cleaner according to claim 2, wherein said hand grip further comprises a lower edge portion that is telescopically received over a top end of said handle stem, a horizontally extending slot passing through said lower edge portion, a lockout pin being horizontally reciprocally mounted in said slot for selective movement between a propelled position and an unpropelled position; and a sideways T-shaped recess having a vertically extending top portion and a horizontally extending leg portion is located in an outer peripheral surface of said handle stem opposite said slot in said hand grip;

wherein said lockout pin has an inner end that is received in said T-shaped recess in said handle stem, whereby when said lockout pin is in said propelled position, said inner end of said lockout pin rides in said top portion of said T-shaped recess allowing said hand grip to reciprocate relative to said handle stem, and when said lockout pin is in said un-propelled position, said inner end of said lockout pin is received in said leg portion of said T-shaped groove locking said hand grip in a position in which the transmission is in neutral.

7. A self-propelled vacuum cleaner according to claim 1, wherein said power switch is a toggle switch and said lower end of said switch rod includes a cam bump that, when said handle stem is attached to said housing, is located in sliding abutting contact with said toggle switch, whereby when an operator actuates said power switch said cam bump actuates said toggle switch.

8. A self-propelled vacuum cleaner according to claim 1, further comprising a T-shaped recess in said lower end of said grip rod and a generally mushroom-shaped end piece attached to the upper end of said control link, said end piece being sized and shaped to be closely received in said T-shaped recess in said grip rod;

wherein said T-shaped recess in said grip rod and said end piece are located such that when said handle stem is attached to said housing said end piece is received in said T-shaped recess for transmitting reciprocal motion of said hand grip to said control link.

9. A self-propelled vacuum cleaner according to claim 8, further comprising a vertically extending slot in said housing and an H-shaped member attached to said mushroom shaped end piece;

wherein said H-shaped member is slidably mounted in said vertical slot in said housing.

10. A self-propelled vacuum cleaner according to claim 8, further comprising a cavity in a top rear portion of said housing, said end piece being located in said cavity;

said cavity being configured to receive said handle stem therein.

11. A self-propelled vacuum cleaner according to claim 10, further comprising a peripheral generally horizontally extending groove located in said cavity;

a generally horizontally extending peripheral flange extends radially out from a front and either side of the lower end of said handle stem, said flange being sized and shaped to be slidably received in said peripheral groove in said cavity, thereby rigidly mounting said handle stem to said housing.

12. A self-propelled vacuum cleaner according to claim 11, wherein said T-shaped recess in said grip rod is located in a front surface of said grip rod; and wherein said handle stem is attached to said housing by moving said handle stem horizontally forward and sliding said peripheral flange on said handle stem horizontally forward into said groove in said cavity, while said T-shaped recess in said grip rod simultaneously moves horizontally forward over said end piece.

13. A self-propelled vacuum cleaner according to claim 11, wherein said power switch is a toggle switch and said lower end of said switch rod includes a cam bump that, when said handle stem is attached to said housing, is located in sliding abutting contact with said toggle switch, whereby when an operator actuates said power switch said cam bump actuates said toggle switch.

14. A self-propelled vacuum cleaner according to claim 13, wherein said toggle switch is mounted in said cavity facing rearward, and said cam bump is located on a forward surface of said switch rod; and wherein said handle stem is attached to said housing by moving said handle stem horizontally forward and sliding said peripheral flange on said handle stem horizontally forward into said groove in said cavity, while said cam bump simultaneously moves horizontally forward into abutting engagement with said toggle switch.

15. A self-propelled vacuum cleaner according to claim 1, wherein said control link is a Bowden type control cable.

16. A self-propelled vacuum cleaner according to claim 1, wherein said control link is a flexible strap.

17. A self-propelled vacuum cleaner according to claim 1, wherein said control link is a rigid linkage.

18. A self-propelled vacuum cleaner having an electric motor, a floor engaging portion having a suction inlet and at least one drive wheel for propelling said vacuum cleaner over a floor surface, a transmission for selectively drivingly connecting said motor to said at least one drive wheel and selectively propelling said cleaner in forward and reverse directions over a floor surface, a housing pivotally connected to said floor engaging portion, wherein the improvement comprises:

a control link in said housing having a lower end attached to said transmission for selectively actuating said transmission into forward, reverse and neutral and a top end located adjacent to said housing remote from said transmission; and a handle stem having a hand grip reciprocally mounted thereon, a lower end of said stem being configured for attachment to said housing by moving said handle stem in a direction normal to a longitudinal axis of said housing; and said hand grip having a connector located such that said connector engages said top end of said control link when said handle stem is attached to said housing and automatically interconnects said control link to said hand grip.

19. A self-propelled vacuum cleaner according to claim 18, wherein said connector comprises:

a grip rod extending down from said hand grip and out a lower end of said handle stem, a lower end of said grip rod being adapted to connect to said top end of said control link when said handle stem is attached to said housing.

20. A self-propelled vacuum cleaner according to claim 19, further comprising a generally mushroom shaped end piece attached to said top end of said control link and a generally T-shaped recess located in a side of said grip rod, said end piece and said T-shaped recess being located such that said end piece is received in said T-shaped recess when said handle stem is attached to said housing.

21. A self-propelled vacuum cleaner according to claim 20, wherein said control link is a Bowden type control cable.

22. A self-propelled vacuum cleaner according to claim 20, further comprising a vertically extending slot in said housing and an H-shaped member attached to said mushroom shaped end piece;

wherein said H-shaped member is slidably mounted in said vertical slot in said housing.

23. A self-propelled vacuum cleaner according to claim 20, further comprising a cavity in a top rear portion of said housing, said end piece being located in said cavity;

a peripheral generally horizontally extending groove located in said cavity;

a generally horizontally extending peripheral flange extends radially out from a front and either side of the lower end of said handle stem, said flange being sized and shaped to be slidably received in said peripheral groove and thereby rigidly attach said handle stem to said housing.

24. A self-propelled vacuum cleaner according to claim 23, wherein said T-shaped recess in said grip rod is located in a front surface of said grip rod; and wherein said handle stem is attached to said housing by moving said handle stem horizontally forward and sliding said peripheral flange on said handle stem horizontally forward into said groove in said cavity, while said T-shaped recess in said grip rod simultaneously moves horizontally forward over said end piece.

25.A self-propelled vacuum cleaner according to claim 24, further comprising a vertically extending slot in said housing and an H-shaped member attached to said mushroom shaped end piece;

wherein said H-shaped member is slidably mounted in said vertical slot in said housing.

* * * * *